US011735864B2

(12) United States Patent
Zhou et al.

(10) Patent No.: US 11,735,864 B2
(45) Date of Patent: Aug. 22, 2023

(54) ELECTRICAL CONNECTOR ASSEMBLY

(71) Applicant: CommScope Technologies LLC, Hickory, NC (US)

(72) Inventors: Yuanyao Zhou, Jiangsu (CN); Jien Zheng, Jiangsu (CN); Yujun Zhang, Jiangsu (CN)

(73) Assignee: CommScope Technologies LLC, Hickory, NC (US)

( * ) Notice: Subject to any disclaimer, the term of this patent is extended or adjusted under 35 U.S.C. 154(b) by 177 days.

(21) Appl. No.: 17/139,301

(22) Filed: Dec. 31, 2020

(65) Prior Publication Data

US 2021/0210901 A1 Jul. 8, 2021

(30) Foreign Application Priority Data

Jan. 3, 2020 (CN) ..... 202020014063.3

(51) Int. Cl.
*H01R 13/627* (2006.01)
*H01R 25/00* (2006.01)
*H01R 13/518* (2006.01)

(52) U.S. Cl.
CPC ..... *H01R 13/6278* (2013.01); *H01R 13/6275* (2013.01); *H01R 25/00* (2013.01); *H01R 13/518* (2013.01)

(58) Field of Classification Search
CPC ..... H01R 25/00; H01R 13/6278; H01R 13/6275; H01R 13/518; H01R 13/6273
See application file for complete search history.

(56) References Cited

U.S. PATENT DOCUMENTS 4,838,804 A * 6/1989 Banjo ..... H01R 12/722 439/325
6,364,675 B1 * 4/2002 Brauer ..... H01R 13/635 439/348
7,125,273 B2 * 10/2006 Irwin ..... H01R 13/6276 439/348
7,878,840 B2 * 2/2011 Hankey ..... H01R 13/6582 439/348
8,939,785 B2 * 1/2015 Chiu ..... H01R 13/621 439/333
9,112,307 B2 * 8/2015 Leroyer ..... H01R 13/6276
9,147,971 B2 * 9/2015 Osada ..... H01R 13/641
9,225,116 B2 * 12/2015 McKibben ..... H01R 13/645
(Continued)

FOREIGN PATENT DOCUMENTS

CN 112805882 A * 5/2021 ..... H01R 13/4226

*Primary Examiner* — Marcus E Harcum
(74) *Attorney, Agent, or Firm* — Myers Bigel, P.A.

(57) ABSTRACT

An electrical connector assembly includes: a first module including a mounting plate and a plurality of first electrical connectors; a second module including a housing and a plurality of second electrical connectors; wherein the electrical connector assembly has a locking device including at least one first interlocking member disposed on the first module and at least one second interlocking member disposed on the second module, wherein one of the first interlocking member and the second interlocking member is provided with a protrusion, and the other of the first interlocking member and the second interlocking member is provided with a hole for receiving the protrusion, wherein one of the projection and the hole is elastically actuatable so as to lock or unlock the first module and the second module.

21 Claims, 4 Drawing Sheets

(56) References Cited

U.S. PATENT DOCUMENTS

| | | | | |
|---|---|---|---|---|
| 9,614,327 | B2 * | 4/2017 | Marsh | H01R 13/641 |
| 9,666,987 | B1 * | 5/2017 | Tanaka | H01R 13/639 |
| 9,806,442 | B2 * | 10/2017 | Geske | H01R 12/716 |
| 9,887,489 | B1 * | 2/2018 | Dietz | H01R 13/6275 |
| 10,050,395 | B2 * | 8/2018 | Ngo | H01R 4/023 |
| 10,063,010 | B2 * | 8/2018 | Ender | H01R 13/6278 |
| 10,601,153 | B2 * | 3/2020 | Maki | H01R 13/639 |
| 10,944,209 | B2 * | 3/2021 | Endler | H02J 7/0013 |
| 2011/0306247 | A1 * | 12/2011 | Montena | H01R 9/0524 439/660 |
| 2014/0370736 | A1 * | 12/2014 | Laurent | H01R 13/6278 439/345 |
| 2019/0148876 | A1 * | 5/2019 | Milroy | H01R 13/523 439/522 |
| 2019/0312394 | A1 | 10/2019 | Paynter et al. | |
| 2020/0044388 | A1 * | 2/2020 | Kanda | H01R 13/641 |
| 2020/0136309 | A1 * | 4/2020 | Grandcoing | H01R 13/641 |
| 2021/0028572 | A1 * | 1/2021 | Little | H01R 13/502 |

* cited by examiner

ELECTRICAL CONNECTOR ASSEMBLY

RELATED APPLICATION

The present application claims priority from and the benefit of Chinese Utility Model Application No. 202020014063.3, filed Jan. 3, 2020, the disclosure of which is hereby incorporated herein in its entirety.

FIELD OF THE INVENTION

The present utility model relates to an electrical connector assembly.

BACKGROUND OF THE INVENTION

Electrical connector assemblies are widely used in the field of electrical or electronic products. In some electrical connector assemblies, for example in an electrical connector assembly known from US 20190312394 A1, as shown in FIGS. 1 and 2, the first module 31 and the second module 32 of the electrical connector assembly can be switched between a locked state and an unlocked state via cooperation of a rocker arm 21 and two posts 30.

However, in such electrical connector assembly, it is very laborious to release the rocker arm 21. Normally, a screwdriver is needed to unlock the first module 31 and the second module 32, which is inconvenient for the user. In addition, since each post 30 is fixed in a recess 20 of the rocker arm 21, in some cases, the post 30 might accidentally slide out of the recess 20 due to deformation of the rocker arm 21 in a direction along the post 30, which results in the first module 31 and the second module 32 of the electrical connector assembly are unlocked unexpectedly.

SUMMARY OF THE INVENTION

One object of the present disclosure is to provide an electrical connector assembly capable of overcoming at least one drawback in the prior art. The electrical connector comprises: a first module including a mounting plate and a plurality of first electrical connectors, wherein the plurality of first electrical connectors are mounted on the mounting plate in a predetermined layout; a second module including a housing and a plurality of second electrical connectors mated with the plurality of first electrical connectors, wherein the plurality of second electrical connectors are mounted in the housing in the predetermined layout; and a locking device including at least one first interlocking member disposed on the first module and at least one second interlocking member disposed on the second module. One of the first interlocking member and the second interlocking member is provided with a protrusion, and the other of the first interlocking member and the second interlocking member is provided with a hole for receiving the protrusion. One of the protrusion and the hole is elastically actuatable to enable it to move between a first position in which the protrusion extends into the hole, such that the first electrical connector and the second electrical connector are engaged with each other and the first module and the second module are locked; and a second position in which the protrusion is disengaged from the hole, such that the first module and the second module are unlocked and the first electrical connector and the second electrical connector are separable from each other.

Potential beneficial technical effects of the present utility model may include: a tool is not needed to operate the locking device of the electrical connector assembly, so that it is convenient for use by the user; the locking device may be highly stable, so that the first module and the second module of the electrical connector assembly can be safely and reliably locked; and the electrical connector assembly has a simple structure and a small volume, and thus saves the material and reduces the burden on the product provider.

In some embodiments, the first locking member may include a connecting piece, wherein a first end portion of the connecting piece is fixed on the mounting plate, and the protrusion is provided on a second end portion of the connecting piece; the second locking member may include a cavity provided in the housing, and the hole is provided in a side wall of the cavity.

In some embodiments, the protrusion is constructed to be an elastically extensible pin.

In some embodiments, the connecting piece includes a transverse hole, wherein the pin is disposed in the transverse hole of the connecting piece, and an elastic element is provided in the transverse hole, such that the pin is capable of performing an elastically extensible movement.

In some embodiments, an end portion of the pin that is capable of projecting out of the transverse hole is constructed to be a rounded portion, and the rounded portion is capable of projecting beyond the side wall of the cavity through the hole for receiving the protrusion when the first module and the second module are locked.

In some embodiments, the pin may be constructed to be a cylindrical pin.

In some embodiments, the hole for receiving the protrusion is constructed to be a circular hole.

In some embodiments, the first locking member may include a connecting piece, wherein a first end portion of the connecting piece is fixed on a mourning plate, and one of the protrusion and the hole is provided on/in a second end portion of the connecting piece; and the second locking member may include a cavity provided in the housing, and a toggle structure is provided on a side wall of the cavity, wherein the toggle structure includes a support plate and a fulcrum, and the support plate is elastically rotatable about the fulcrum, wherein the other of the protrusion and the hole is constructed on a first end portion of the support plate.

In some embodiments, a button may be provided on a second end portion of the support plate.

In some embodiments, the protrusion may be constructed to be a wedge-shaped protrusion.

In some embodiments, the hole may be constructed to be a rectangular hole.

In some embodiments, the locking device may include two first interlocking members and two second interlocking members.

In some embodiments, at least one friction button may be provided on an outer wall of the housing.

In some embodiments, the first end portion of the connecting piece may be fixed on the mounting plate in a threaded connection manner.

In some embodiments, the housing may be an injection-molded member.

In some embodiments, the mounting plate may be a mounting plate made of brass.

In some embodiments, the connecting piece may be a connection rod made of brass.

In some embodiments, the pin may be a pin made of brass or steel.

BRIEF DESCRIPTION OF THE DRAWINGS

After reading the embodiments below in combination with the drawings, a plurality of aspects of the present disclosure will be better understood.

DETAILED EMBODIMENTS OF THE INVENTION

The present utility model will be described below with reference to the accompanying drawings. The accompanying drawings show embodiments of the present utility model. It should be understood, however, that the present utility model may be presented in multiple different ways, and not limited to the embodiments described below. In fact, the embodiments described hereinafter are intended to make a more complete disclosure of the present utility model and to adequately explain the protection scope of the present utility model to a person skilled in the art. It should also be understood that, the embodiments disclosed herein can be combined in various ways to provide more additional embodiments.

It should be understood that, the wording in the specification is only used for describing particular embodiments and is not intended to define the present utility model. All the terms used in the specification have the meanings as normally understood by a person skilled in the art, unless otherwise defined. For the sake of conciseness and clarity, the well-known functions or constructions may not be described in detail any longer. The wordings "comprising", "containing" and "including" used in the specification indicate the presence of the claimed features, but do not repel the presence of one or more other features.

Figure 1:
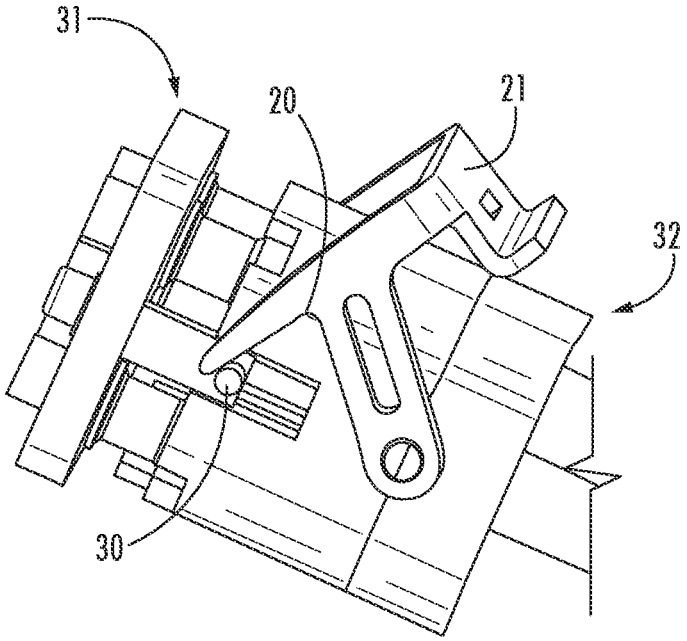
FIG. 1 (PRIOR ART)
FIG. 1 is a perspective view of an electrical connector assembly in an unlocked state according to the prior art.
Figure 2:
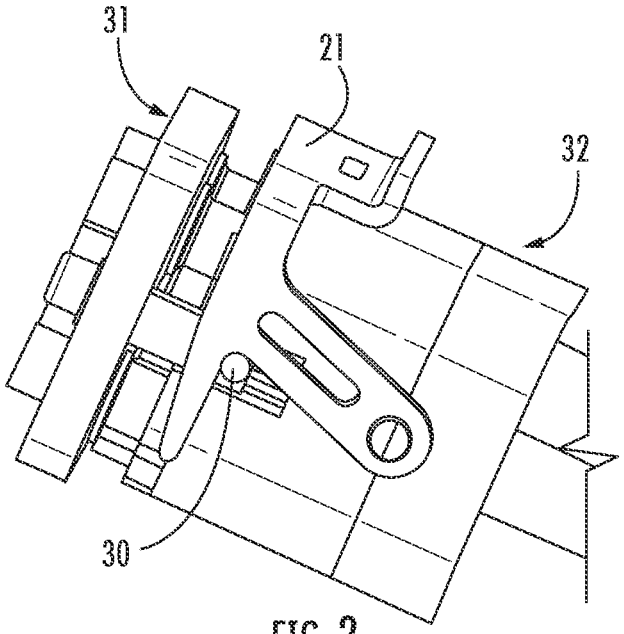
FIG. 2 (PRIOR ART)
FIG. 2 is a perspective view of an electrical connector assembly in a locked state according to the prior art.
Figure 3:
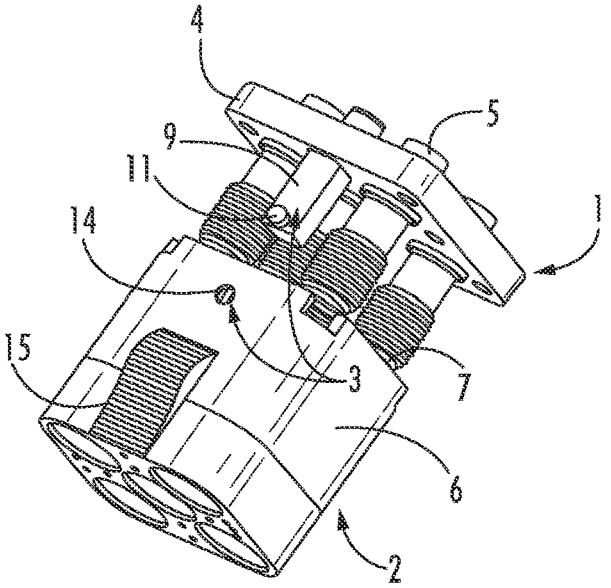
FIG. 3 is a perspective view of an electrical connector assembly in an unlocked state according to one embodiment of the present utility model.
Figure 4:
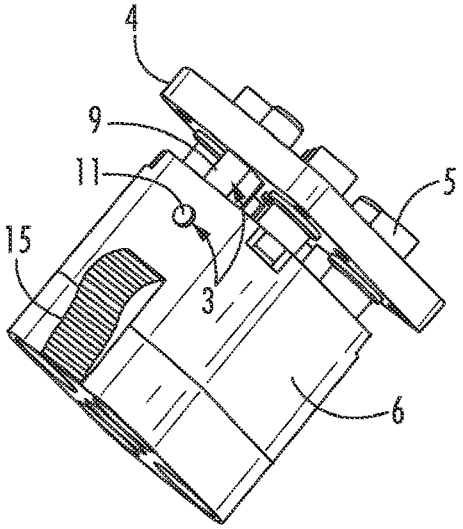
FIG. 4 is a perspective view of an electrical connector assembly in a locked state according to one embodiment of the present utility model.

Referring to FIGS. 3 and 4, an electrical connector assembly in an unlocked and locked state according to one embodiment of the present utility model is shown. The electrical connector assembly comprises a first module 1, a second module 2, and a locking device 3. The first module 1 and the second module 2 can be switched between a locked state and an unlocked state by the locking device 3.

The first module 1 includes a mounting plate 4 and a plurality of first electrical connectors 5. The mounting plate 4 may be rectangular. The plurality of first electrical connectors 5 may comprise five first electrical connectors. One of the five first electrical connectors 5 is mounted in the center of the mounting plate 4 and each of the other four first electrical connectors is mounted in a corner area of the rectangular mounting plate (see FIG. 6). The mounting plate 4 may be, for example, a mounting plate made of brass. The second module 2 includes a housing 6 and a plurality of second electrical connectors 7 mated with the plurality of first electrical connectors 5. The plurality of second electrical connectors 7 are mounted in the housing 6 in the same layout as that of the plurality of first electrical connectors 5. The housing 6 may be an injection-molded member.

The locking device 3 includes at least one first interlocking member disposed on the first module 1 and at least one second interlocking member disposed on the first module 2. In one embodiment, as shown in FIG. 3, the locking device 3 includes two first interlocking members disposed in opposite areas of the first module 1 and two second interlocking members disposed in opposite areas of the second module 2. The first interlocking member may include a connecting piece 9. The first end portion of the connecting piece 9 may be fixed on the mounting plate 4 in a threaded connection manner. The second end portion of the connecting piece 9 is provided with a protrusion 11. The second interlocking member may include a cavity 18 constructed in the housing 6 to receive the connecting piece 9. A hole 14 for receiving the protrusion 11 is formed in the side wall of the cavity 18.

Figure 5A:
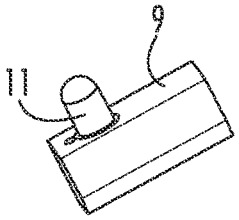
FIG. 5*a* is a detailed view of a first interlocking member of the electrical connector assembly shown in FIG. 3.
Figure 5B:
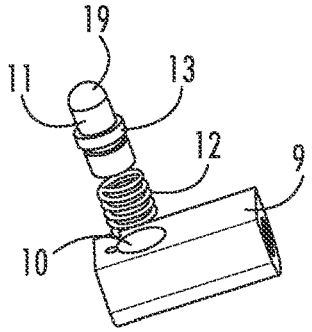
FIG. 5*b* is an exploded view of the first interlocking member shown in FIG. 5*a;*

In some embodiments, the protrusion 11 may be constructed, for example, to be an elastically extensible pin, which will be explained in more detail by way of FIGS. 5*a*, and 5*b*. As may be explicitly seen from FIG. 5*a*, the connecting piece 9 may be a connection rod made of brass. A transverse hole 10 is provided in the second end portion of the connecting piece 9. The protrusion 11 is constructed to be a pin provided in the transverse hole 10. An elastic element 12 is provided in the transverse hole 10 so that the pin may be elastically extensible. The elastic element 12 may be, for example, a coil spring, a leaf spring, a bellows, or the like made of steel. The pin may be a pin made of brass or steel. As shown in FIG. 5*b*, the first interlocking member may further include a stopper 13 for retaining the pin in the transverse hole 10, so that the pin is prevented from moving out of the transverse hole 10. The stopper 13 may be constructed, for example, to be an annular member made of steel. The pin may perform an elastically extensible movement in the transverse hole 10 through the annular member.

With configuring the protrusion 11 as an elastically extensible pin, the second end portion of the connecting piece 9 can be inserted into the cavity 18 of the housing 6 from the position shown in FIG. 3, and the protrusion 11 can elastically extend into the hole 14 (see FIG. 4). Under such a circumstance, the first electrical connectors 5 and the second electrical connectors 7 can be engaged with each other and the first module 1 and the second module 2 are locked. In order to unlock the first module 1 and the second module 2, the protrusion 11 may be disengaged from the hole 14 for example by pressing the protrusion 11. In this way, the second end portion of the connecting piece 9 can be pulled out from the cavity 18, and the first electrical connectors 5 and the second electrical connectors 7 can be separated from each other (see FIG. 3).

In some embodiments, the pin may be constructed to be a cylindrical pin. Correspondingly, the hole 14 may be constructed to be a circular hole. However, the present disclosure is not limited thereto, and the pin and the hole 14 may be provided in other shapes as required. To facilitate the movement of the pin into/out of the hole 14, the end portion of the pin that can project out of the transverse hole 10 may include a rounded portion 19. The rounded portion 19 may project beyond the side wall of the cavity 18 through the hole 14 to lock the first module 1 and the second module 2 (see FIG. 4).

In addition, in the embodiments shown in FIGS. 3 and 4, the first module 1 includes five first electrical connectors 5 and the second module 2 includes five second electrical connectors 7. However, the present disclosure is not limited thereto, the first module 1 and the second module 2 may include any plurality of first electrical connectors 5 and second electrical connectors 7 respectively, with the number of the first electrical connectors 5 is same with that of the second electrical connectors 7. In addition, the first electrical connectors 5 and the second electrical connectors 7 may also be mounted on the mounting plate 4 and in the housing 6 respectively in any complementary mating layout.

In some embodiments, the first electrical connectors 5 may be a male radio frequency (RF) connector, and the second electrical connectors 7 may be a female RF connector. In other embodiments, the first electrical connectors 5 may be a RF frequency connector, and the second electrical connectors 7 may be a male RF connector.

In some embodiments, in order to facilitate the user to hold and operate the second module 2, at least one friction button 15 may be provided on the outer wall of the housing 6. As shown in FIGS. 3 and 4, two friction buttons 15 may be provided on two opposite outer walls of the housing 6.

Figure 6:
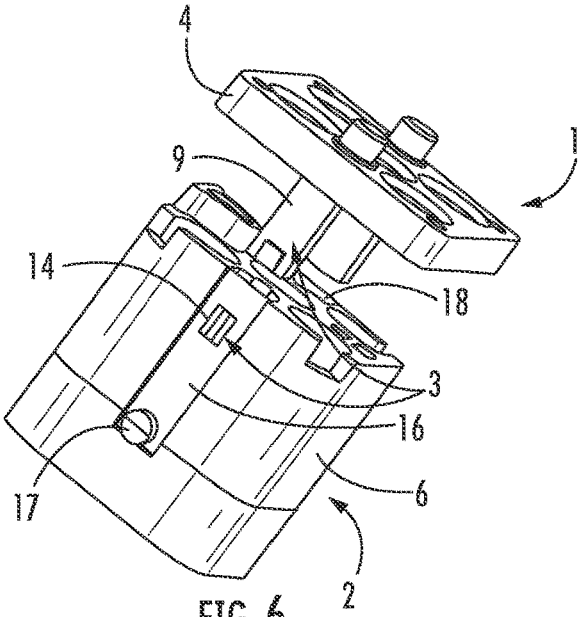
FIG. 6 is a perspective view of an electrical connector assembly in an unlocked state according to another embodiment of the present utility model.
Figure 7:
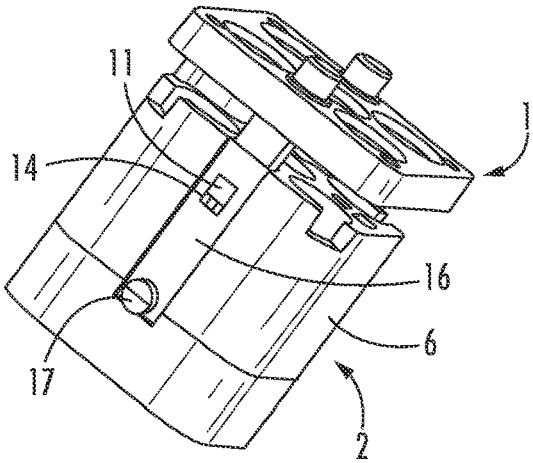
FIG. 7 is a perspective view of an electrical connector assembly in a locked state according to another embodiment of the present utility model.
Figure 9:
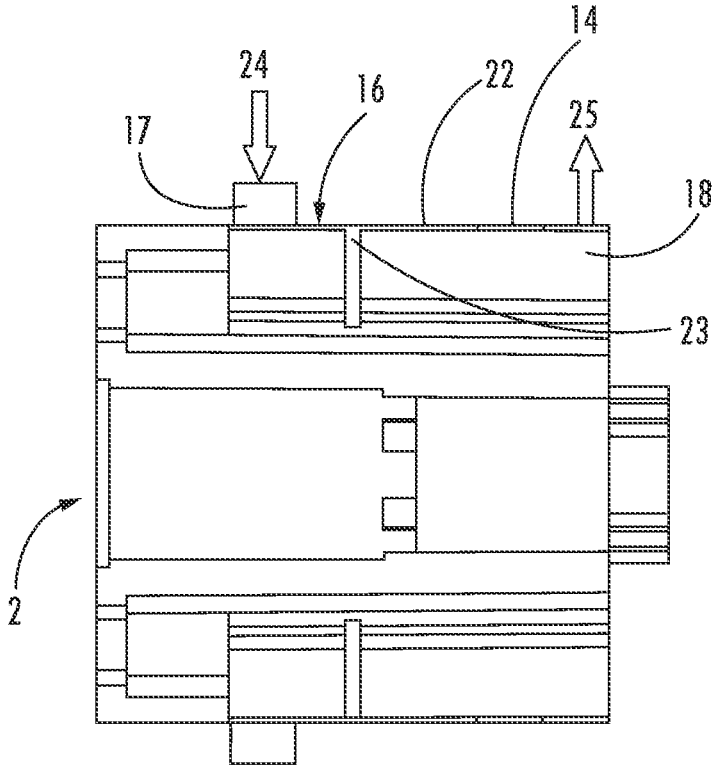
FIG. 9 is a side view of a second module of the electrical connector assembly shown in FIG. 6, which shows the structure of the second interlocking member.

FIGS. 6 and 7 respectively show perspective views of an electrical connector assembly in an unlocked and locked state according to another embodiment of the present utility model. For the sake of clarity, the first electrical connectors 5 and the second electrical connectors 7 are not shown in FIGS. 6 and 7. Unlike the embodiments shown in FIGS. 3 and 4, in the electrical connector assembly shown in FIGS. 6 and 7, the second interlocking member may include a toggle structure 16 constructed on a side wall of the cavity 18. As shown more explicitly in FIG. 9, the toggle structure 16 includes a support plate 22 and a fulcrum 23, wherein the support plate can elastically rotate about the fulcrum. Specifically, when the second end portion of the support plate 22 is pressed (represented by the arrow 24), the first end portion of the support plate 22 may be raised (represented by the arrow 25); and when the second end portion of the support plate 22 is released, the first end portion of the support plate 22 may spring back to its initial position. The fulcrum 23 may be, for example, a support member formed in the cavity 18 of the housing 6 in a manner such as threaded connection, welding, or integral molding with the cavity 18.

In some embodiments, as shown in FIGS. 6 and 7, the protrusion 11 is constructed on the second end portion of the connecting piece 9, while the hole 14 is constructed on the first end portion of the support plate 22 of the toggle structure 16. The second end portion of the connecting piece 9 can be inserted into the cavity 18 of the housing 6 from the position shown in FIG. 6, so that the protrusion 11 extends into the hole 14 (see FIG. 7). Under such a circumstance, the first electrical connectors 5 and the second electrical connectors 7 can be engaged with each other and the first module 1 and the second module 2 are locked. In order to unlock the first module 1 and the second module 2, the first end portion of the support plate and the hole 14 provided therein may be raised by pressing the second end portion of the support plate 22, so that the protrusion portion 11 can be disengaged from the hole 14. When the protrusion 11 is completely disengaged from the hole 14, the first module 1 and the second module 2 are unlocked, Under such a circumstance, the second end portion of the connecting piece 9 can be pulled out from the cavity 18, and the first electrical connectors 5 and the second electrical connectors 7 can be separated from each other (see FIG. 6). In order to facilitate the pressing operation, a button 17 may be provided on the second end portion of the support plate of the toggle structure 16.

Figure 8:
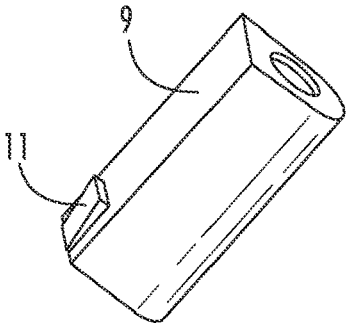
FIG. 8 is a detailed view of a first interlocking member of the electrical connector assembly shown in FIG. 6.

In this embodiment, as shown in FIG. 8, the protrusion 11 may be constructed to be a wedge-shaped protrusion which does not have to be constructed to be elastically extensible as shown in FIGS. 3 and 4. Correspondingly, the hole 14 may be constructed to be a rectangular hole (see FIGS. 6 and 7).

In other embodiments, the hole 14 may be provided in the second end portion of the connecting piece 9, and the protrusion 11 may be provided on the first end portion of the support plate 22 of the toggle structure 16. For example, the protrusion 11 may be provided on the side of the first end portion of the support plate 22 that faces the cavity 18. In such embodiment, the first module 1 and the second module 2 may also be locked and unlocked by pressing the second end portion of the support plate 22 or pressing the button 17.

Compared with the prior art, advantages of the electrical connector assembly according to the above-described specific embodiments of the present utility model may include the following aspects: since a rocker arm is not used, a tool is not needed to operate the locking device, so that it is convenient for use by the user; the locking device may be highly stable, so that the first module 1 and the second module 2 can be safely and reliably locked; and the electrical connector assembly has a simple structure and a small volume, and thus saves the material and reduces the burden on the product provider.

Although the exemplary embodiments of the present disclosure have been described above, a person skilled in the art should understand that, he or she can make multiple changes and modifications to the exemplary embodiments of the present disclosure without departing from the spirit and scope of the present disclosure. Accordingly, all the changes and modifications are encompassed within the protection scope as defined by the claims of the present utility model.

The invention claimed is:

1. An electrical connector assembly comprising:

a first module including a mounting plate and a plurality of first electrical connectors, wherein the plurality of first electrical connectors are mounted on the mounting plate in a predetermined layout;

a second module including a housing and a plurality of second electrical connectors mated with the plurality of first electrical connectors, wherein the plurality of second electrical connectors are mounted in the housing in the predetermined layout; and a locking device including at least one first interlocking member disposed on the first module and at least one second interlocking member disposed on the second module, wherein one of the first interlocking member and the second interlocking member is provided with a protrusion, and the other of the first interlocking member and the second interlocking member is provided with a through hole for receiving the protrusion; and wherein one of the protrusion and the hole is elastically actuatable to enable it to move between a first position in which the protrusion extends into the through hole, such that the first electrical connectors and the second electrical connectors are engaged with each other and the first module and the second module are locked; and a second position in which the protrusion is disengaged from the through hole, such that the first module and the second module are unlocked and the first electrical connectors and the second electrical connectors are separable from each other, wherein the first interlocking member includes a connecting piece, wherein a first end portion of the connecting piece is fixed on the mounting plate, and the protrusion is provided on a second end portion of the connecting piece, and the second interlocking member includes a cavity provided in the housing and configured to receive the second end portion of the connecting piece, and the through hole is provided in a side wall of the cavity.

2. The electrical connector assembly according to claim 1, wherein the protrusion is constructed to be an elastically extensible pin.

3. The electrical connector assembly according to claim 2, wherein the connecting piece includes a transverse hole, wherein the pin is disposed in the transverse hole of the connecting piece, and an elastic element is provided in the transverse hole, such that the pin is capable of performing an elastically extensible movement.

4. The electrical connector assembly according to claim 3, wherein an end portion of the pin that is capable of projecting out of the transverse hole is constructed to be a rounded portion, and the rounded portion is capable of projecting beyond the side wall of the cavity through the through hole for receiving the protrusion when the first module and the second module are locked.

5. The electrical connector assembly according to claim 2, wherein the pin is constructed to be a cylindrical pin.

6. The electrical connector assembly according to claim 5, wherein the through hole for receiving the protrusion is constructed to be a circular hole.

7. The electrical connector assembly according to claim 1, wherein the first interlocking member includes a connecting piece, wherein a first end portion of the connecting piece is fixed on the mounting plate, and one of the protrusion and the through hole is provided on/in a second end portion of the connecting piece, and the second interlocking member includes a cavity provided in the housing, and a toggle structure is provided on a side wall of the cavity, wherein the toggle structure includes a support plate and a fulcrum, and the support plate is elastically rotatable about the fulcrum, and wherein the other of the protrusion and the through hole is constructed on a first end portion of the support plate.

8. The electrical connector assembly according to claim 7, wherein a button is provided on a second end portion of the support plate.

9. The electrical connector assembly according to claim 7, wherein the protrusion is constructed to be a wedge-shaped protrusion.

10. The electrical connector assembly according to claim 9, wherein the through hole is constructed to be a rectangular hole.

11. The electrical connector assembly according to claim 1, wherein the interlocking device includes two first interlocking members and two second interlocking members.

12. The electrical connector assembly according to claim 1, wherein at least one friction button is provided on an outer wall of the housing.

13. The electrical connector assembly according to claim 1, wherein a first end portion of the connecting piece is fixed on the mounting plate in a threaded connection manner.

14. The electrical connector assembly according to claim 1, wherein the housing is an injection-molded member.

15. The electrical connector assembly according to claim 1, wherein the mounting plate is made of brass.

16. The electrical connector assembly according to claim 1, wherein the connecting piece is a connection rod made of brass.

17. The electrical connector assembly according to claim 2, wherein the pin is made of brass or steel.

18. An electrical connector assembly comprising:

a first module including a mounting plate and a plurality of first electrical connectors, wherein the plurality of first electrical connectors are mounted on the mounting plate in a predetermined layout;

a second module including a housing and a plurality of second electrical connectors mated with the plurality of first electrical connectors, wherein the plurality of second electrical connectors are mounted in the housing in the predetermined layout; and a locking device including at least one first interlocking member disposed on the first module and at least one second interlocking member disposed on the second module, wherein one of the first interlocking member and the second interlocking member is provided with a protrusion, and the other of the first interlocking member and the second interlocking member is provided with a hole for receiving the protrusion;

wherein the first interlocking member includes a connecting piece, wherein a first end portion of the connecting piece is fixed on the mounting plate, and one of the protrusion and the hole is provided on/in a second end portion of the connecting piece, and the second interlocking member includes a cavity provided in the housing, and a toggle structure is provided on a side wall of the cavity, wherein the toggle structure includes a support plate and a fulcrum, and the support plate is elastically rotatable about the fulcrum, and wherein the other of the protrusion and the hole is constructed on a first end portion of the support plate, and wherein one of the protrusion and the hole is elastically actuatable to enable it to move between a first position in which the protrusion extends into the hole, such that the first electrical connectors and the second electrical connectors are engaged with each other and the first module and the second module are locked; and a second position in which the protrusion is disengaged from the hole, such that the first module and the second module are unlocked and the first electrical connectors and the second electrical connectors are separable from each other.

19. The electrical connector assembly according to claim 18, wherein a button is provided on a second end portion of the support plate.

20. The electrical connector assembly according to claim 18, wherein the protrusion is constructed to be a wedge-shaped protrusion.

21. The electrical connector assembly according to claim 20, wherein the hole is constructed to be a rectangular hole.

* * * * *